US005590679A

United States Patent [19]

Almasy et al.

[11] Patent Number: 5,590,679

[45] Date of Patent: Jan. 7, 1997

[54] WALL WATER HYDRANT HAVING BACKFLOW AND BACK SIPHONAGE PREVENTOR

[75] Inventors: Lawrence Almasy; James F. Shuler; Robert J. Vandepas; William L. Carlson, all of Colorado Springs, Colo.

[73] Assignee: WCM Industries, Inc., Colorado Springs, Colo.

[21] Appl. No.: 350,693

[22] Filed: Dec. 6, 1994

Related U.S. Application Data

[63] Continuation-in-part of Ser. No. 88,889, Jul. 8, 1993.

[51] Int. Cl.[6] ..... F16K 15/14; F16K 15/18

[52] U.S. Cl. ..... 137/218; 137/360; 137/614.2; 137/854

[58] Field of Search ..... 137/218, 360, 137/614.2, 853, 854

[56] References Cited

U.S. PATENT DOCUMENTS

| | | | |
|---|---|---|---|
| 2,329,960 | 9/1943 | Verheul | 137/854 X |
| 2,652,224 | 9/1953 | Noland | 137/360 |
| 2,949,933 | 8/1960 | Moen | 137/119 X |
| 3,056,418 | 10/1962 | Adams et al. | 137/119 |
| 3,384,113 | 5/1968 | Pennisi | 137/853 |
| 4,008,732 | 2/1977 | Fichter et al. | 137/119 |
| 4,134,424 | 1/1979 | Zeyra et al. | 137/853 X |
| 4,182,356 | 1/1980 | Woodford, Sr. . | |
| 4,209,033 | 6/1980 | Hirsch et al. . | |
| 4,286,616 | 9/1981 | Botnick . | |
| 4,300,593 | 11/1991 | Ritter | 137/853 X |
| 4,577,653 | 3/1986 | Marty | 137/119 |
| 4,609,006 | 9/1986 | Parkison et al. | 137/854 X |
| 4,619,287 | 10/1986 | Hama et al. . | |
| 4,798,221 | 1/1989 | Crawford et al. | 137/119 |
| 5,054,517 | 10/1991 | Liesenhoff et al. | 137/854 X |
| 5,205,325 | 4/1993 | Piper | 137/853 X |
| 5,217,040 | 6/1993 | Hochstrasser | 137/218 |

*Primary Examiner*—Gerald A. Michalsky

*Attorney, Agent, or Firm*—Zarley, McKee, Thomte, Voorhees, & Sease

[57] ABSTRACT

A wall mounted water hydrant has an elongated hollow housing with water inlet and outlet ends, and a center axis; an inlet valve in the housing adjacent to the inlet end, including a valve seat and a valve body; a water outlet port in the housing adjacent to its outlet end; a valve operating rod in the housing with an inner end secured to the valve body and extending along the center axis to the outlet end of said housing, terminating in an outer end; a handle attached to the rod outer end, which when rotated in one direction closes the valve body against the valve seat, and in the other opposite direction moves the valve body away from the seat, thus allowing pressurized water from the inlet to flow downstream through the housing and outlet port; and a backflow preventor secured to the valve downstream from its seat. The elastomeric backflow preventor has a bell shape comprising a cylindrical body smaller than the interior of the housing and thin flexible side walls extending from the body outwardly and downstream to end in a lip portion which normally engages the interior walls of the housing. The backflow preventor has an open inner end with an inwardly extending shoulder which frictionally fits into an annular groove of the valve body. The inner end of the preventor abuts an annular shoulder on the valve body and is held thereagainst by a locking band.

16 Claims, 4 Drawing Sheets

WALL WATER HYDRANT HAVING BACKFLOW AND BACK SIPHONAGE PREVENTOR

CROSS REFERENCE TO A RELATED APPLICATION

This is a continuation-in-part of co-pending application Ser. No. 08/088,889 filed Jul. 8, 1993.

BACKGROUND OF THE INVENTION

This invention relates to the protection of water hydrants from undesirable backpressure backflow, and back siphonage backflow. Hoses and equipment are frequently connected to freezeless outdoor water hydrants to accomplish various tasks. Significant backpressure or siphonage can be encountered during some tasks, particularly if a break occurs in the primary water line.

Freezeless wall faucets or hydrants are known in the art. Generally, these devices include a hollow housing having an interior inlet and connected to a source of pressurized water and an exterior outlet. A valve is included within the housing and is connected by means of a rod to a manually operable handle outside the housing. Rotation of the handle causes the valve to open and close. Freezeless faucets are normally wall-mounted on the exterior of a building with the valve extending inwardly with respect to the building to a point where the valve is protected from freezing by warmth from the interior of the building. The handle and outlet are located on the exterior of the building.

A freezeless water faucet with a removable valve cartridge is shown in U.S. Pat. No. 4,821,762 to Breneman. The removable valve cartridge is supported on an operating rod which extends centrally within a bore in the elongated housing of the faucet. Various methods have been tried in conjunction with such faucets to control the flow and backpressure within to prevent damage and contamination. Unfortunately, face sealing backflow preventors like the one shown by Breneman adversely affect the output flow characteristics of the faucet and require a separate spring and seat for proper sealing. In freezeless faucets, it is difficult to accommodate backpressure preventors within the housing without interfering with the operation of the centrally located valve cartridge.

Therefore, a principal object of this invention is to provide an improved backpressure and back siphonage preventor for a freezeless hydrant.

A further object of the present invention is to provide a backflow and back siphonage preventor which is mounted to the operating rod and seals against the wall of the hollow housing when the fluid forces are greater downstream than upstream of the preventor.

A further object of the present invention is to provide a backflow and back siphonage preventor which allows water to be delivered from the source so long as the valve is open and the fluid forces are greater upstream than downstream of the preventor.

A further object of the present invention is to provide a backflow and back siphonage preventor which is durable, readily serviceable, inexpensive to manufacture, and capable of self-flushing for removal of debris during operation.

A further object of this invention is to prevent failure of the backflow preventor, and particularly the sealing element forming a part thereof, under conditions of high fluid pressure.

SUMMARY OF THE INVENTION

The wall mounted water hydrant of this invention has an elongated hollow housing with water inlet and outlet ends, and a center axis; a water inlet valve means in the housing adjacent to the inlet end, including a valve seat and a valve body; a water outlet port in the housing adjacent to its outlet end; a valve operating rod in the housing with its inner end secured to the valve body and an outer end extending along the center axis to the outlet end of said housing where a handle is attached thereto for rotating the operating rod. Rotation of the rod in one direction will advance the valve body on to the valve seat, and rotation of the rod in an opposite direction will retract the valve body away from the seat, Thus providing a gap therebetween through which pressurized water connected to the inlet can flow in a downstream direction through the housing and exit through the outlet port. A backflow preventor element is secured to the valve means downstream from the valve seat. The term backflow preventor as used herein will refer to both the concepts of back siphonage backflow as well as backpressure backflow.

The backflow preventor has a cylindrical body element with a smaller diameter than the interior of the housing and an outward cylindrical periphery with a flexible flange normally extending outwardly therefrom to engage the interior surface of the housing. The flexible flange is constructed to permit it to deflect toward the axis of the housing when water is flowing in a downstream direction and to deflect outwardly from the housing axis to engage the interior surface of the housing if backpressure or back siphonage urges water to flow in an upstream direction. Thus the housing and valve means are selectively sealed against backflow occurring from all causes. Part or all of the backflow preventor may be made from elastomeric material for improved deflection and sealing characteristics. The backflow preventor has a hollow or bell shape with triangular shaped flange that can bear against the interior surface of the housing to create a seal under backflow conditions.

DESCRIPTION OF THE PREFERRED EMBODIMENT

Figures 1, 2, 3:
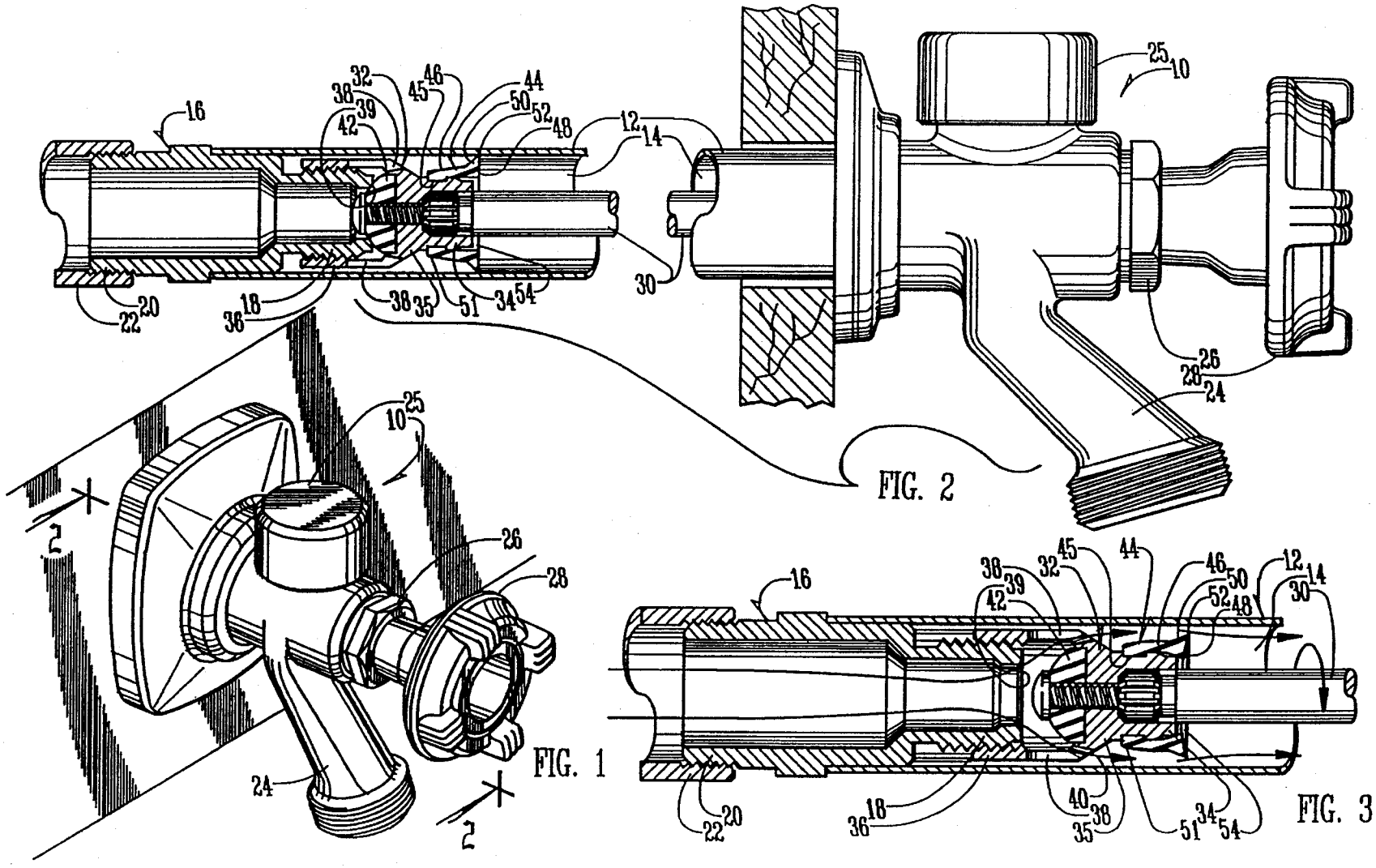
FIG. 1 is a perspective view of the water hydrant of the present invention mounted to the outer wall of a house.
FIG. 2 is a sectional view taken along line 2—2 of FIG. 1 showing the water hydrant in its closed position.
FIG. 3 is an enlarged sectional view of the hydrant in its open position.

Referring to FIG. 1, the numeral 10 generally designates the wall-mounted water hydrant of the present invention. As shown in FIG. 2, hydrant 10 includes a hollow elongated housing 12 having a central elongated bore 14. One end of bore 14 is in sealed engagement with the middle portion of a hollow brass connector 16. The upper and lower ends 18, 20 of connector 16 have male pipe threads as showing in FIG. 2. The lower end 20 of connector 16 is threaded into inlet pipe 22, which is connected to a conventional source of pressurized water. The other end of bore 14 is connected to a water outlet port 24 and a vacuum breaker 25, which the particulars of are not crucial to the present invention.

A movable valve assembly 26, located centrally and removably within bore 14, is in conventional sealed engagement with the end of the bore 14 that is associated with the outlet port 24. Movable valve assembly 26 can be retracted from a close position shown in FIG. 2 to the open position shown in FIG. 3 by a manual means for rotating, such as a handle 28, which is connected to one end of an elongated operating rod 30. Referring again to FIG. 2, the other end of operating rod 30 is connected to the upper end of a valve casing 32.

Figure 4:
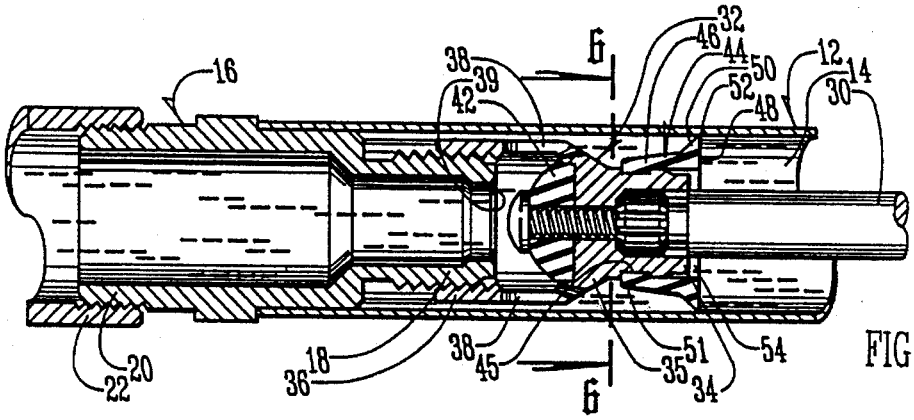
FIG. 4 is a view similar to FIG. 3, but showing the valve assembly in its open, but backflow preventing position.
Figure 5:
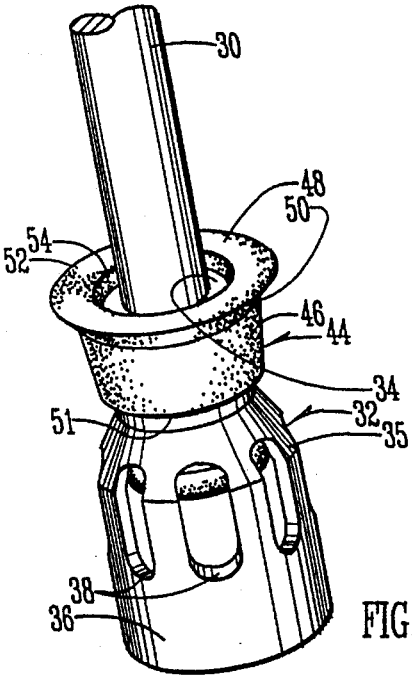
FIG. 5 is a perspective view of the valve assembly with the backflow preventor of this invention installed thereon.
Figure 6:
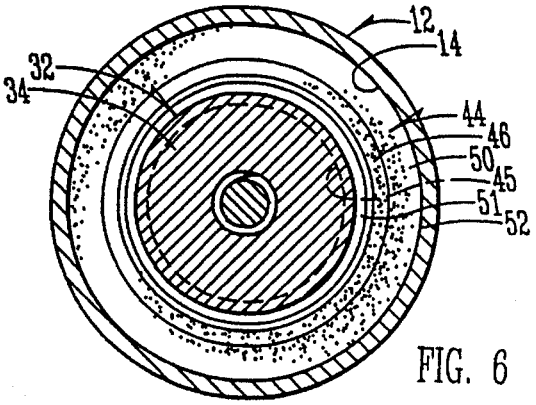
FIG. 6 is a sectional view taken along line 6—6 of FIG. 4 showing the backflow preventor on the valve assembly.

Valve casing 32 has upper and lower portions 34, 36. The lower portion 36 is larger in diameter than the upper portion 34 and there is an intermediate necked portion 35 between the two. As best seen in FIG. 5, the lower portion 36 of valve casing 32 is hollow with a plurality of apertures 38 extending through the lower portion 36 and into the necked portion 35. Apertures 38 allow water to flow from the inlet through the valve assembly 26 to the outlet port 24 under conditions shown in FIG. 3. FIG. 2 shows that lower portion 36 of valve casing 32 and the upper end 18 of connector 16 are joined in conventional sealed engagement by pipe threads. When its threads are fully engaged, the upper end 18 of connector 16 extends adjacent to, but does not completely cover the apertures 38 in valve casing 32. As shown in FIG. 4 and FIG. 6, the inside of the necked portion 35 of the valve casing 32 and the upper end of connector 16 form annular seats 39 around a valve opening 40.

Valve closure element or body 42 is fastened by conventional means to the end of operating rod 30 opposite handle 26. Valve body 42 is smaller in diameter than the interior of the lower portion 36 of valve casing 32, but greater in diameter than the interior of the upper end 18 of connector 16. To assemble movable valve assembly 26, operating rod 28 is first attached to the upper portion 34 of valve casing 32. Then valve body 42 is put inside the lower portion 36 of the valve casing 32 and then fastened to the end of operating rod 30. The resulting movable valve assembly 26, shown in FIG. 2 and FIG. 5, can be retracted or advanced axially within bore 14 by rotating handle 28. When handle 28 is rotated in one direction, valve body 42 eventually comes into contact with the end of connector 16 as shown in FIG. 2. In this position, valve body 42 is seated on seats 39 and the flow of fluid from inlet pipe 22 to the outlet port 24 is blocked.

FIG. 6 shows valve assembly 26 after it has been rotated in the opposite direction. Valve body 42 has been withdrawn from seats 39 to create a valve opening 40. Valve body 42 acts in conjunction with connector 16 to form an inlet valve means for operating the hydrant. Fluid is thereby permitted to flow through inlet pipe 22, connector 16, valve opening 40, apertures 38 around operating rod 30 and to outlet port 24.

FIG. 4 shows the effects of backpressure on the hydrants of this invention. To prevent backflow, which can be caused by excessive water pressure at outlet port 24, a backflow preventor 44 is installed into groove 45 in the upper portion 34 of valve casing 32 downstream of the valve seats 39.

Figure 7B:
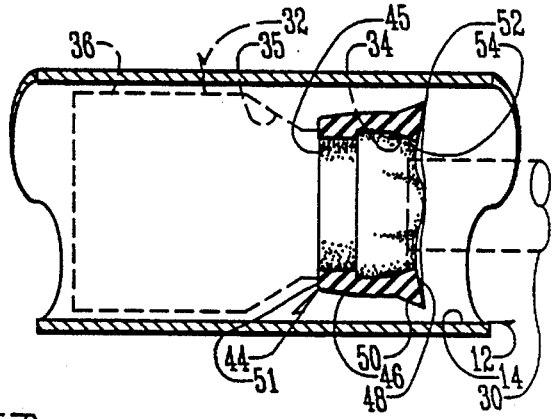
FIG. 7B is an enlarged section view of the backflow preventor, in its crimped state, deflecting toward the axis of the housing to allow inlet water to flow over the preventor.
Figure 7A:
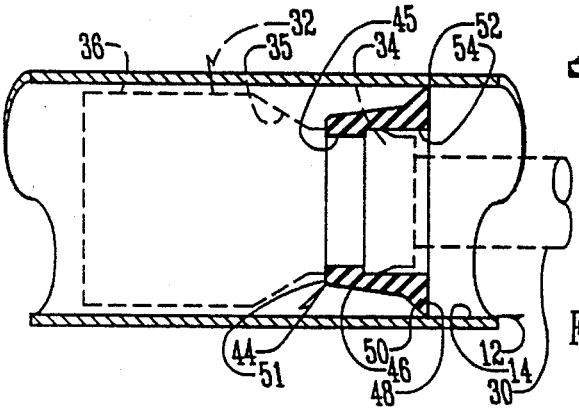
FIG. 7A is an enlarged section view of the backflow preventors, in its expanded state, sealing against the interior of the housing.

Backflow preventor 44 is preferably made of a resilient, elastomeric material, such as rubber. FIG. 7A shows that preventor 44 is shaped like a hollow bell. A cylindrical base portion 46 has an outer diameter less than housing bore 14. The inner diameter of base portion 46 is large enough to be stretched over the upper portion 34 of valve casing 32 on operating rod 30 during installation, but small enough to seal effectively against water pressure when seated in groove 45. Thus, preventor 44 can be easily replaced if it becomes worn or damaged.

Thin, flexible inner and outer side walls 48, 51 extend downstream and diagonally outward from base portion 46 toward outlet port 24 to terminate in a triangular radial cross sectional shaped flange 50 which in turn terminates in a pointed cylindrical lip portion 52. In the free state of preventor 44, lip 52 normally engages housing bore 14 to seal against flow. Walls 48 and 51 constitute the opening of the bell shape and they encompass a hollow interior 54, which accommodates the valve casing 32 on rod 30 and the deflection or crimping of walls 48 and 51 when necessary.

Walls 48 and 51 and interior 54 present areas against which water pressure can act, forcing preventor 44 to crimp or expand in response to flow or backflow, respectively. Outer wall 51 presents an angled surface against which, under normal conditions, the pressure of inlet flow will act to force, deflect, or crimp preventor 44 toward the central axis of bore 14. Lip 52 is forced out of sealed engagement with the walls of bore 14 and water from the inlet is permitted to flow over preventor 44 to outlet port 24. This normally flowing condition of hydrant 10 is shown in FIGS. 3 and 7B. On the other hand, when downstream pressure urges backflow, inner wall 48 and hollow interior 54 react to the backpressure by expanding outwardly from the central axis of bore 14. Lip 52 is forced back into sealed engagement with the walls of bore 14. Whenever the effects of downstream pressure are greater on preventor 44 than the forces from inlet flow, it will automatically seal off bore 14 to prevent backflow as shown in FIGS. 4 and 7A.

FIGS. 2–4 show that, in the preferred embodiment, the flange size is selected to achieve a slip fit with bore 14. Therefore, valve assembly 26 can be easily installed, rotated, and removed. No backflow may leak past preventor 44 because it seals against the walls of housing bore 14 in its naturally expanded state.

FIG. 3 shows inlet pressure deflecting the upstream-directed surfaces of flange 50 away from the wall of bore 14 and toward the central axis of the same. This deflection or crimping allows water to flow from inlet 22, around backflow preventor 44, to outlet port 24. Therefore, hydrant 10 supplies water in the usual manner with minimal obstruction. Preventor 44 is crimped by inlet pressure to lay just above the upper portion 34 valve casing 32.

FIG. 4 shows how the backflow preventor 44 works when the downstream pressure (at outlet port 24) is greater than inlet pressure. The stronger pressure from flow in an upstream direction forces the flange 50 outward into sealed engagement with the wall of bore 14. This prevents backflow from the outlet 24 to the inlet 22. Contamination is avoided, whether backpressure backflow or back siphonage occurs. Further, this invention enhances the conventional function of vacuum breaker 25, and creates an effective anti-siphonage phenomenon. An unexpected result is that this invention also creates an effective backpressure backflow phenomenon. In addition, the ability of the backflow preventor to collapse during normal flow as shown in FIG. 7B permits the hydrant to be automatically flushed to free itself of any debris in the water, and therefore is essentially free of fouling.

FIGS. 8 through 11A show several modifications of valve casing 32. Where these modified valve casings have structure similar to that of valve casing 32, like numerals will be used.

Figure 8:
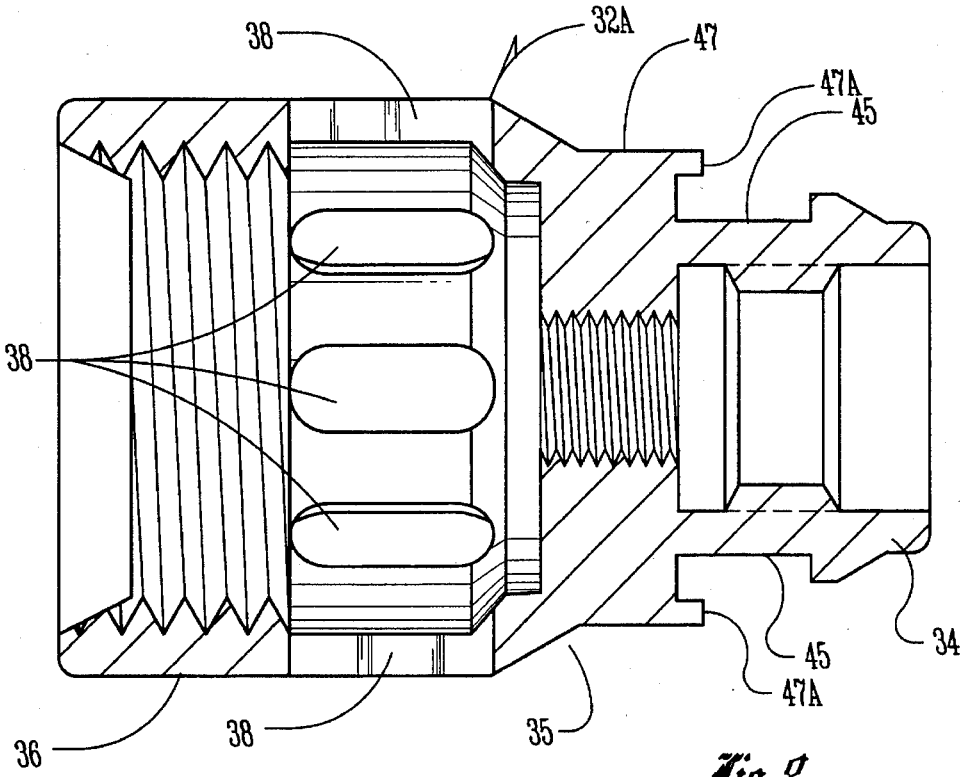
FIG. 8 is a large scale sectional view through a modified form of a valve casing.
Figure 8A:
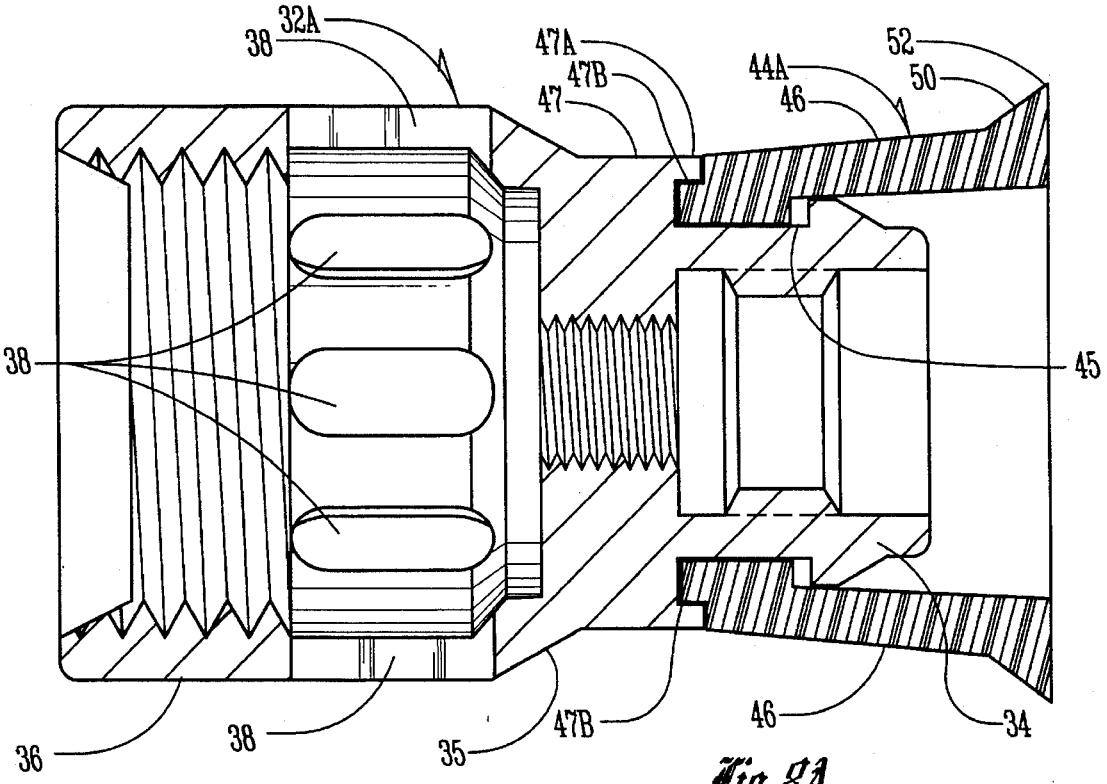
FIG. 8A is a view similar to that of FIG. 8 but shows a backflow preventor mounted thereon.

FIGS. 8 and 8A show valve casing 32A which has an annular shoulder 47 thereon. A peripheral lip 47A extends outwardly over a portion of the annular groove 45. The backflow preventor 44A has a circular recess 47B to receive the peripheral lip 47A.

Figure 9:
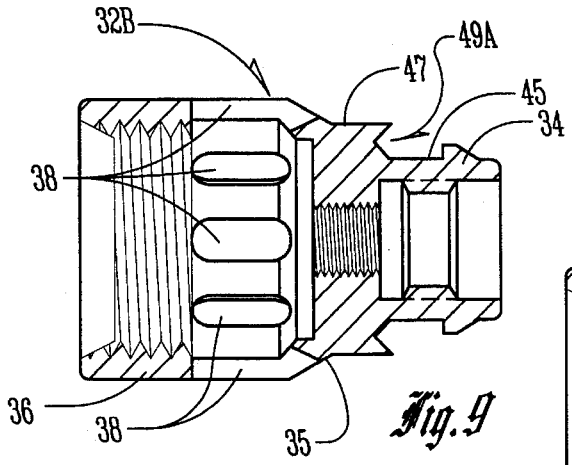
FIG. 9 is a smaller scale cross sectional view through a modified form of a valve casing.
Figure 9A:
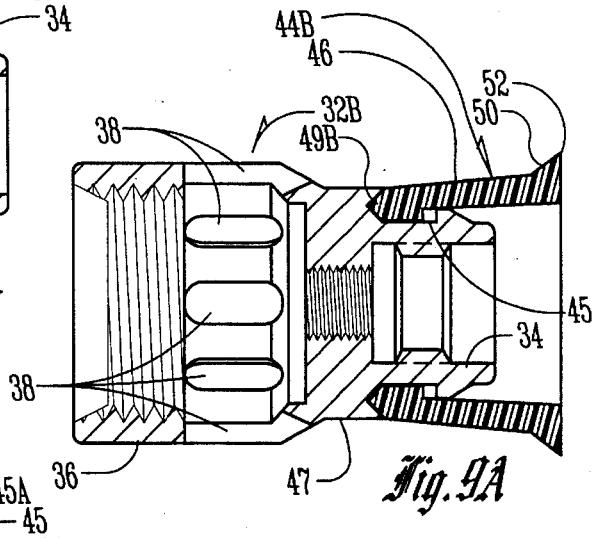
FIG. 9A is a view similar to that of FIG. 9 but shows a backflow preventor mounted thereon.

Valve casing 32B is shown in FIGS. 9 and 9A. Annular shoulder 47 terminates in a horizontally disposed V-shaped recess 49A. Backflow preventor 44B has a V-shaped edge 49B to fit into the recess 49A of valve casing 32B (FIG. 9A).

Figure 10:
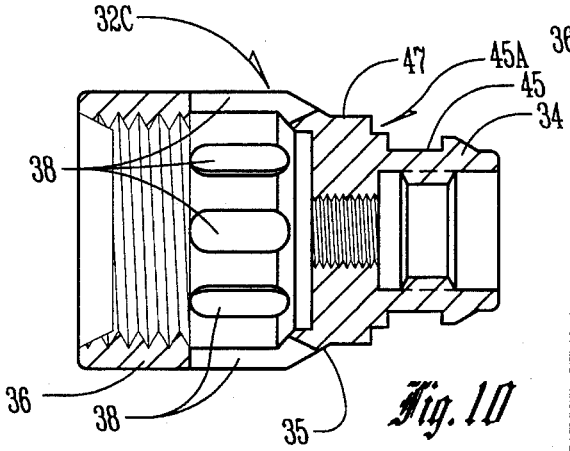
FIG. 10 is a smaller scale cross sectional view through a modified form of a valve casing.
Figure 10A:
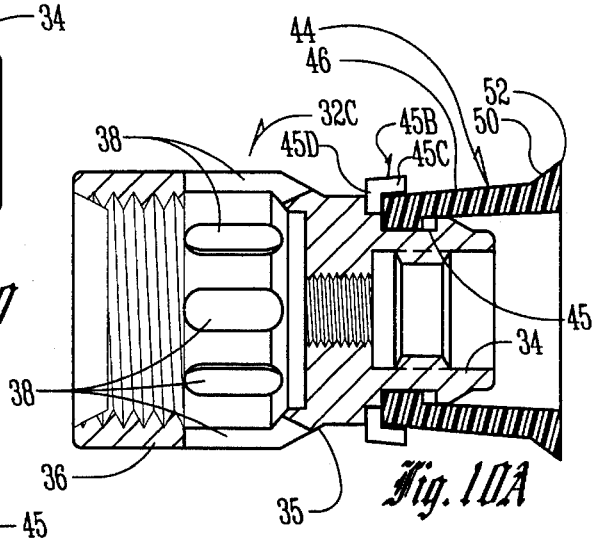
FIGS. 10A is a view similar to that of FIG. 10 but shows a backflow preventor mounted thereon.

Valve casing 32C is shown in FIGS. 10 and 10A. Shoulder 47 has a rectangular shaped peripheral notch 45A therein. FIG. 10A shows backflow preventor 44 mounted in annular groove 45 but with a clamping band 45B extending therearound. Band 45B has a horizontal flange 45C and a vertical flange 45D. Flange 45C embraces the outside of one end of backflow preventor 44 with the flange 45D extending into the peripheral notch 45A. Band 45B is of continuous construction and serves to clamp backflow preventor 44 to the valve casing 32C.

Figure 11:
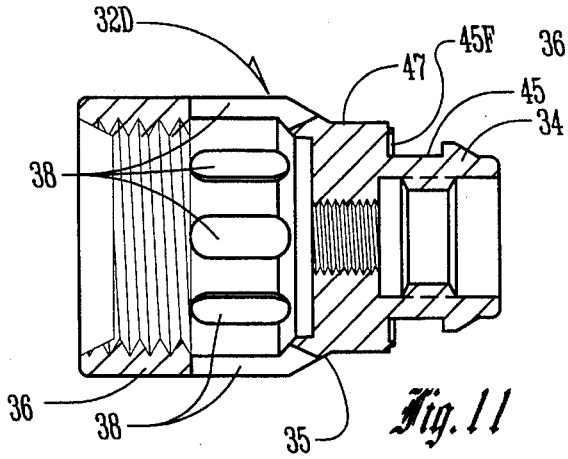
FIG. 11 is a smaller scale cross sectional view through a modified form of a valve casing.
Figure 11A:
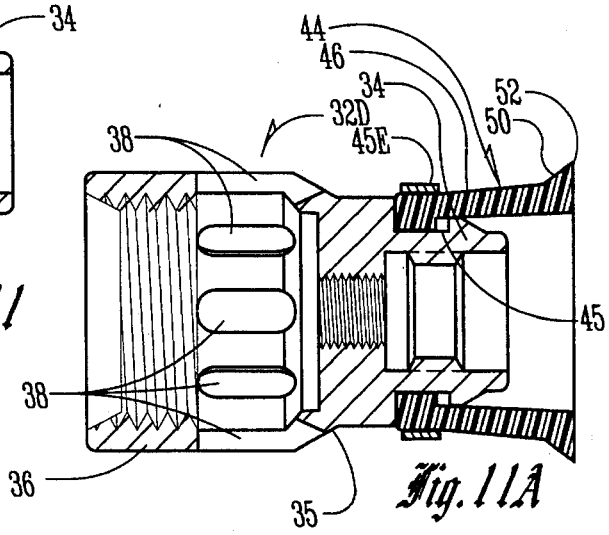
FIG. 11A is a view similar to that of FIG. 11 but shows a backflow preventor mounted thereon.

FIG. 11A shows backflow preventor 44 mounted on valve casing 32D with a clamping band 45E which is one dimensional and corresponds essentially to the flange 45C of clamping band 45B.

FIG. 11 shows valve casing 32D without the backflow preventor 44 mounted thereon. Shoulder 47 has a circular bead 45F thereon to enhance the tight connection between the valve casing 32D and the backflow preventor 44. When backflow preventor 44 is mounted on the valve casing 32D of FIG. 11, the use of clamping band 45E is optional. If backflow preventor 44 is used when the bead 45F is not used, the band 45E adds additional assurance that the backflow preventor will not be removed from the valve casing.

The various alternative valve casing and backflow preventor configurations shown in FIGS. 8 through 11A serve to guarantee that the backflow preventor will not be removed from the valve casing even during periods of high fluid pressure.

The devices of FIGS. 8–11A are mounted within the hydrant in the same manner as the valve casing described generally in FIGS. 1–7B.

From the foregoing, it is seen that this invention will achieve at least all of its stated objectives.

What is claimed is:

1. A valve casing and backflow preventor for a wall hydrant, comprising a hollow valve casing of one piece construction having first and second ends, a bell shaped flexible backflow preventor having open first and second ends, said second end of said backflow preventor having a peripheral sealing surface, said second end of said backflow preventor extending outwardly beyond the second end of said valve casing, said valve casing having a tapered annular shoulder on its second end adapted to have the first end of said backflow preventor fitted thereover, an annular groove in said valve casing adjacent said annular shoulder, and an inwardly projecting annular shoulder on said first end of said backflow preventor mounted in tight engagement within the annular groove in said valve casing; said inwardly projecting annular shoulder being sufficiently large to be frictionally fitted over said tapered annular shoulder on said valve casing for insertion into the annular groove in said valve casing.

2. The device of claim 1 wherein the annular shoulder on said valve casing has a peripheral lip extending outwardly over a portion of said annular groove, with the first end of said backflow preventor having a circular recess to receive said peripheral lip.

3. The device of claim 2 wherein said peripheral lip is rectangular in cross-section.

4. The device of claim 1 wherein the annular shoulder on said valve casing has a horizontally disposed V-shaped annular recess therein, with the first end of said backflow preventor having a horizontally disposed V-shaped element received in said annular recess.

5. The device of claim 1 wherein a clamping band extends around the first end of said backflow preventor to maintain said inwardly projecting annular shoulder with the annular groove in said valve casing.

6. The device of claim 5 wherein said band is L-shaped in configuration with horizontal and vertical flanges, with said horizontal flange embracing the first end of said backflow preventor and said vertical flange being mounted in a recess in the annular shoulder of said valve casing.

7. The device of claim 1 wherein a circular sealing bead is located on the annular shoulder of said casing and is in sealing engagement with the first end of said backflow preventor.

8. The device of claim 1 wherein said valve casing is positioned in a water hydrant having an elongated housing having a center axis and fluid inlet and outlet ends, a valve operating rod in said housing secured to said casing for selective longitudinal movement of said casing within said housing, said casing and said backflow preventor and said sealing surface being held against longitudinal movement within said housing by said rod except when said rod is being selectively moved.

9. The device of claim 8 wherein said elongated housing has an inner surface, said sealing surface is normally in an extended position of engagement with said inner surface, said sealing surface being sufficiently flexible so that it can be deformed inwardly towards said center axis from its normally extended position upon flow of fluid from said fluid inlet end to permit fluid flow thereby towards said fluid outlet end, and to extend to said extended position of engagement with said inner surface when subjected to fluid flow from said outlet end towards said inlet end.

10. The device of claim 1 wherein said sealing surface is in the form of a pointed cylindrical lip.

11. A valve casing and backflow preventor for a wall hydrant, comprising a hollow valve casing of one piece construction having first and second ends, a bell shaped flexible backflow preventor having open first and second ends, said second end of said backflow preventor having a peripheral sealing surface, said valve casing having a tapered annular shoulder on its second end adapted to have the first end of said backflow preventor fitted thereover, an annular groove in said valve casing adjacent said annular shoulder, and an inwardly projecting annular shoulder on said first end of said backflow preventor mounted in tight engagement within the annular groove in said valve casing; said inwardly projecting annular shoulder being sufficiently large to be frictionally fitted over said tapered annular shoulder on said valve casing for insertion into the annular groove in said valve casing, the first end of said backflow preventor having an outer diameter substantially the same as the outer diameter of said valve casing adjacent the first end of said backflow preventor.

12. The device of claim 11 wherein said valve casing is positioned in a water hydrant having an elongated housing having a center axis and fluid inlet and outlet ends, a valve operating rod in said housing secured to said casing for selective longitudinal movement of said casing within said housing, said casing and said backflow preventor and said sealing surface being held against longitudinal movement within said housing by said rod except when said rod is being selectively moved.

13. The device of claim 12 wherein said elongated housing has an inner surface, said sealing surface is normally in an extended position of engagement with said inner surface, said sealing surface being sufficiently flexible so that it can be deformed inwardly towards said center axis from its normally extended position upon flow of fluid from said fluid inlet end to permit fluid flow thereby towards said fluid outlet end, and to extend to said extended position of engagement with said inner surface when subjected to fluid flow from said outlet end towards said inlet end.

14. A valve casing and backflow preventor for a wall hydrant, comprising a hollow valve casing of one piece construction having first and second ends, a bell shaped flexible backflow preventor having open first and second ends and a center axis, said second end of said backflow preventor having a flexible peripheral sealing surface, said sealing surface being sufficiently flexible so that it can be deformed inwardly towards said center axis from a first normally extended position upon flow of fluid in one axial direction when positioned in a fluid conduit, to permit fluid flow thereby in said one direction, and to extend to said first normally extended position when subject to fluid flow in an axial direction opposite to that of said one axial direction, said valve casing having a tapered annular shoulder on its second end adapted to have the first end of said backflow preventor fitted thereover, an annular groove in said valve casing adjacent said annular shoulder, and an inwardly projecting annular shoulder on said first end of said backflow preventor mounted in tight engagement within the annular groove in said valve casing; said inwardly projecting annular shoulder being sufficiently large to be frictionally fitted over said tapered annular shoulder on said valve casing for insertion into the annular groove in said valve casing.

15. The device of claim 14 wherein said valve casing is positioned in a water hydrant having an elongated housing having a center axis and fluid inlet and outlet ends, a valve operating rod in said housing secured to said casing for selective longitudinal movement of said casing within said housing, said casing and said backflow preventor and said sealing surface being held against longitudinal movement within said housing by said rod except when said rod is being selectively moved.

16. The device of claim 15 wherein said elongated housing has an inner surface, said sealing surface is normally in an extended position of engagement with said inner surface, said sealing surface being sufficiently flexible so that it can be deformed inwardly towards said center axis from its normally extended position upon flow of fluid from said fluid inlet end to permit fluid flow thereby towards said fluid outlet end, and to extend to said extended position of engagement with said inner surface when subjected to fluid flow from said outlet end towards said inlet end.

* * * * *